US011329387B2

(12) United States Patent
Da Silveira et al.

(10) Patent No.: US 11,329,387 B2
(45) Date of Patent: May 10, 2022

(54) SINGLE AND DUAL POLARIZED DUAL-RESONANT CAVITY BACKED SLOT ANTENNA (D-CBSA) ELEMENTS

(71) Applicant: Telefonaktiebolaget LM Ericsson (publ), Stockholm (SE)

(72) Inventors: Marthinus Willem Da Silveira, Ottawa (CA); Neil McGowan, Stittsville (CA)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 16/982,486

(22) PCT Filed: Mar. 29, 2018

(86) PCT No.: PCT/IB2018/052162

§ 371 (c)(1),
(2) Date: Sep. 18, 2020

(87) PCT Pub. No.: WO2019/186238

PCT Pub. Date: Oct. 3, 2019

(65) Prior Publication Data

US 2021/0021048 A1 Jan. 21, 2021

(51) Int. Cl.

| | |
|---|---|
| ***H01Q 13/18*** | (2006.01) |
| ***H01Q 5/335*** | (2015.01) |
| ***H01Q 5/50*** | (2015.01) |

(52) U.S. Cl.

CPC ..... *H01Q 13/18* (2013.01); *H01Q 5/335* (2015.01); *H01Q 5/50* (2015.01)

(58) Field of Classification Search

CPC ..... H01Q 5/335; H01Q 5/50; H01Q 13/18
See application file for complete search history.

(56) References Cited

U.S. PATENT DOCUMENTS 4,710,775 A * 12/1987 Coe ..... H01Q 13/18 343/727
4,792,809 A 12/1988 Gilbert et al.
4,812,855 A * 3/1989 Coe ..... H01Q 9/065 343/700 MS (Continued)

OTHER PUBLICATIONS

Chin et al., "Wideband LTCC 60-GHz Antenna Array With a Dual-Resonant Slot and Patch Structure", IEEE Transactions on Antennas and Propagation, vol. 62, No. 1, Jan. 2014, pp. 174-182.

(Continued)

*Primary Examiner* — Lam T Mai
(74) *Attorney, Agent, or Firm* — NDWE LLP

(57) ABSTRACT

An antenna element comprises a housing having a base and a conducting plate, and a feeding element. The housing has a cavity formed between the base and the conducting plate. The conducting plate has a radiating slot with a length and a width that extends longitudinally along a first axis and a second axis, respectively. The radiating slot has a first and a second edge along the first axis. The feeding element has a feeding point, a feeding line, and a stub. The feeding line extends along the second axis of the conducting plate across the width of the radiating slot such that a first end of the feeding line is coupled with the feeding point on one side of the radiating slot, and a second end of the feeding line extends past the second edge, and the stub extends laterally of the feeding line.

19 Claims, 13 Drawing Sheets

(56) References Cited

U.S. PATENT DOCUMENTS 5,202,697 A * 4/1993 Bonebright ..... H01Q 3/24 343/708
5,446,471 A * 8/1995 Chung ..... H01Q 13/18 343/767
5,461,393 A * 10/1995 Gordon ..... H01Q 9/0407 343/700 MS
5,896,107 A * 4/1999 Huynh ..... H01Q 9/0457 343/700 MS
6,225,959 B1 * 5/2001 Gordon ..... H01Q 13/103 343/700 MS
6,414,647 B1 * 7/2002 Lee ..... H01Q 9/28 343/727
6,639,560 B1 * 10/2003 Kadambi ..... H01Q 1/243 343/700 MS
2004/0056814 A1 * 3/2004 Park ..... H01Q 21/24 343/771
2005/0134520 A1 * 6/2005 Rawat ..... H01Q 1/2208 343/873
2009/0091499 A1 * 4/2009 Dean ..... H01Q 9/0407 343/700 MS
2009/0231215 A1 * 9/2009 Taura ..... H01Q 1/243 343/702
2011/0074642 A1 3/2011 Miller et al.
2013/0249756 A1 * 9/2013 Honda ..... H01Q 21/0062 343/770
2014/0134958 A1 * 5/2014 Sanchez ..... H04B 1/1027 455/73
2015/0077300 A1 * 3/2015 Wang ..... H01Q 13/106 343/771
2015/0244079 A1 * 8/2015 White ..... H01Q 15/0086 343/913
2015/0263432 A1 * 9/2015 White ..... H01Q 15/002 343/913
2020/0208914 A1 * 7/2020 Van Asbrouck ..... F26B 3/06
2020/0295436 A1 * 9/2020 Ueda ..... H01Q 1/38

OTHER PUBLICATIONS

Hirokawa et al., "Cavity-backed wide slot antenna", IEEE Proceedings, vol. 136, No. 1, Feb. 1989, pp. 29-33.
International Search Report and Written Opinion, PCT App. No. PCT/IB2018/052162, dated Dec. 19, 2018, 13 pages.
Li et al., "Inverted Microstrip-Fed Cavity-Backed Slot Antennas", IEEE Antennas and Wireless Propagation Letters, vol. 1, 2002, pp. 98-101.
Luo et al., "Planar Slot Antenna Backed by Substrate Integrated Waveguide Cavity", IEEE Antennas and Wireless Propagation Letters, vol. 7, 2008, pp. 236-239.
Paryani, Rajesh C., "Design of a Wideband Dual-Polarized Cavity Backed Slot Antenna", Ph. D. Thesis, College of Engineering & Computer Science, University of Central Florida, Spring Term, 2010, 85 pages.
Singh et al., "Design of Aperture Coupled Fed Micro-Strip Patch Antenna for Wireless Communication", 2006 Annual IEEE India Conference, IEEE, Sep. 1, 2016, 6 pages.
Yang et al., "Design of a Broadband Cavity-Backed Multislot Antenna", 2013 Proceedings of the International Symposium on Antennas and Propagation (ISAP), Jan. 2013, 4 pages.
Yun et al., "Bandwidth Enhancement of Cavity-Backed Slot Antenna Using a Via-Hole Above the Slot", IEEE Antennas and Wireless Propagation Letters, vol. 11, 2012, pp. 1092-1095.
International Preliminary Reporton Patentability, PCT App. No. PCT/IB2018/052162, dated Oct. 8, 2020, 9 pages.

* cited by examiner

SINGLE AND DUAL POLARIZED DUAL-RESONANT CAVITY BACKED SLOT ANTENNA (D-CBSA) ELEMENTS

CROSS-REFERENCE TO RELATED APPLICATIONS

This application is a National stage of International Application No. PCT/IB2018/052162, filed Mar. 29, 2018, which is hereby incorporated by reference.

TECHNICAL FIELD

Embodiments of the invention relate to the field of antennas; and more specifically, to the slot antennas.

BACKGROUND ART

With the rapid growth of mobile data traffic, there is a need for a more efficient radio technology, that provides higher data rates and better spectrum utilization. Recent development in radio systems (e.g., 5G) make use of small antenna elements to allow for very high data rates, very low latency, ultra-high reliability, energy efficiency and extreme device densities.

Typically, small radio elements are manufactured with one or more layers with a thin conductor (e.g., a metal) located on a dielectric substrate. The process of manufacturing these antenna elements is similar to the process of manufacturing printed circuit board (PCB).

Patch antenna elements are exemplary elements that may be used to enable high frequency in a radio antenna. A patch antenna element has a radiating element on top of a dielectric substrate. To make the patch antenna wideband, it is desirable to have the height of the radiating element as large as possible above a ground plane. However, in a patch antenna element if the height of the radiating element relative to the freespace wavelength is large (e.g., in the order of $0.3/(2\pi\sqrt{\varepsilon_r})$ or larger then surface and reflected waves can propagate in the dielectric substrate affecting the mutual coupling between the multiple patch antenna elements. The mutual coupling leads to scan blindness when the spacing between the patch antenna elements of a radio antenna is larger than 0.5 wavelengths. Scan blindness is undesirable as it creates the effect where at some scanning angles little or no power is transmitted.

The cavity backed slot antenna is an example of antenna element that can overcome the mutual coupling and scan blindness problems observed in patch antennas. In several slot antenna designs the feed element is above the radiator element on a thin dielectric substrate. For example, "Inverted Microstrip-Fed Cavity-Backed Slot Antennas, Quan Li, Institute of Electrical and Electronics Engineers (IEEE) Antennas and Propagation, 2002;" and "Wideband LTCC 60-GHz antenna array with a dual-resonant slot and patch structure, Kuo-Sheng Chin, IEEE transactions on antennas and propagation, vol. 62, no. 1, January 201" are examples of slot antenna designs. However, having the feed element above the radiator element is not desirable as it affects the radiation characteristics. "Design of a Wideband Dual-Polarized Cavity Backed Slot Antenna, Rajesh C Paryani, Ph. D. Thesis, 2010" is another example of slot antenna with a dual feed element above the radiator element to create two resonances. This design of a slot antenna is very sensitive to tolerances as the feed element has to be extremely precise.

In several slot antenna designs, the feed element is inside a cavity. However, some of these designs are either narrowband (up to 6% 10 dB bandwidth). "Bandwidth Enhancement of Cavity-Backed Slot Antenna Using a Via-Hole Above the Slot, Sumin Yun, Dong-Yeon Kim, IEEE antennas and wireless propagation letters, VOL. 11, 2012;" and "Planar Slot Antenna Backed by Substrate Integrated Waveguide Cavity, Guo Qing Luo, IEEE antennas and wireless propagation letters, vol. 7, 2008" are examples of narrowband slot antennas. Some slot antenna can be designed to be wideband, yet they present other undesirable characteristics. For example, in "Cavity-backed wide slot antenna, J. Horokawa, IEE proceedings, vol. 136, 1989," the radiation characteristics are not desirable as radiation patterns have very unequal beamwidths in the principle planes (i.e., in the E-plane and in the H-plane).

"Design of a Broadband Cavity-Backed Multislot Antenna, Jing-yu Yang, Proceedings of the International Symposium on Antennas & Propagation (ISAP), Volume: 01, 2013" is another wideband design of a slot antenna, where the feed element is inside the cavity. However, the antenna element is not suitable for use in an antenna array with a typical spacing between adjacent antenna elements of 0.5 to 0.6 wavelengths, since the antenna element size is one to two wavelengths (over the bandwidth).

SUMMARY OF THE INVENTION

One aspect of the present invention describes an antenna element comprising a housing having a base and a conducting plate. The housing has a cavity formed between the base and the conducting plate. The cavity is coupled to the conducting plate at an upper edge of the housing. The conducting plate has a radiating slot with a length and a width that extends longitudinally along a first axis and a second axis, respectively. The slot has a first and a second edge along the first axis. The antenna element includes a feeding element having a feeding point, a feeding line, and a stub. The feeding element is located in the cavity at a first predetermined distance between the base and the conducting plate for enabling dual resonant frequency impedance matching. The feeding line extends along the second axis of the conducting plate across the width of the radiating slot such that a first end of the feeding line is coupled with the feeding point on one side of the radiating slot, adjacent the first edge of the radiating slot and a second end of the feeding line extends past the second edge of the radiating slot, and the stub extends laterally of the feeding line.

Various implementations may include one or more of the following features. The antenna element may further include two or more stubs, each one of the two or more stubs is coupled to the feeding line at a respective distance and is located between the first end of the feeding line and the first edge of the radiating slot.

The antenna element where walls of the housing are formed using vias connecting the conducting plate with a ground plane forming the base of the housing.

The antenna element where the first predetermined distance is mid-way between the base and the conducting plate.

The antenna element where the feeding element is an active feeding element and the feeding line is an active feeding line and is to be coupled with a signal source through the feeding point, and where the antenna element further includes: a passive feeding element, un-coupled from a signal source, including a passive feeding line located at an opposite end of the radiating slot away from the active feeding element, the passive feeding line extending across the radiating slot such that a first end of the passive feeding line with the passive feeding element extends past the second edge of the radiating slot and a second end of the passive feeding line extends past the first edge of the radiating slot.

The antenna element where the passive feeding element further includes a passive stub extending laterally of the passive feeding line.

The antenna element where the radiating slot is a first radiating slot and the conducting plate defines a second radiating slot at right angle to the first radiating slot for enabling a dual polarized cavity backed slot antenna element, the second radiating slot having a first edge and second edge along the second axis, the antenna element further includes: a second feeding element having a feeding point, a feeding line and a stub, the second feeding element of the second radiating slot is located in the cavity at a first predetermined distance between the base and the conducting plate, the feeding line of the second radiating slot extending along the first axis of the conducting plate across the width of the second radiating slot such that a first end of the feeding line of the second radiating slot is coupled with the feeding point of the second radiating slot on one side thereof, adjacent one edge of the second radiating slot and a second end of the feeding line extends past another edge of the second radiating slot, and the stub of the second feeding line extending laterally of the second feeding line. The antenna element, where the stub extends laterally of the feeding line, perpendicular thereof for a first portion of the stub and parallel to the feeding line for second portion of the stub. The antenna element, where the cavity in said housing is formed between the base, the conducting plate and a plurality of spaced apart vias extending between the base and the conducting plate to form cavity walls.

The antenna element where the vias are spaced apart at a distance of less than or equal to 0.1 wavelength of an operating frequency of the antenna element.

The antenna element where the cavity has at least one of an octagonal, a circular and rectangular shape.

The antenna element where the antenna element is realized as a multilayer printed circuit board (PCB) structure. The antenna element where the feeding element is a stripline located in a layer between the conducting plate and a ground plane. The antenna element where the shape of the radiating slot is at least one of a concave bisymmetric hexagon, a trapezoid, a rectangle, a convex polygon.

BRIEF DESCRIPTION OF THE DRAWINGS

The invention may best be understood by referring to the following description and accompanying drawings that are used to illustrate embodiments of the invention. In the drawings.

DETAILED DESCRIPTION

Figure 1A:
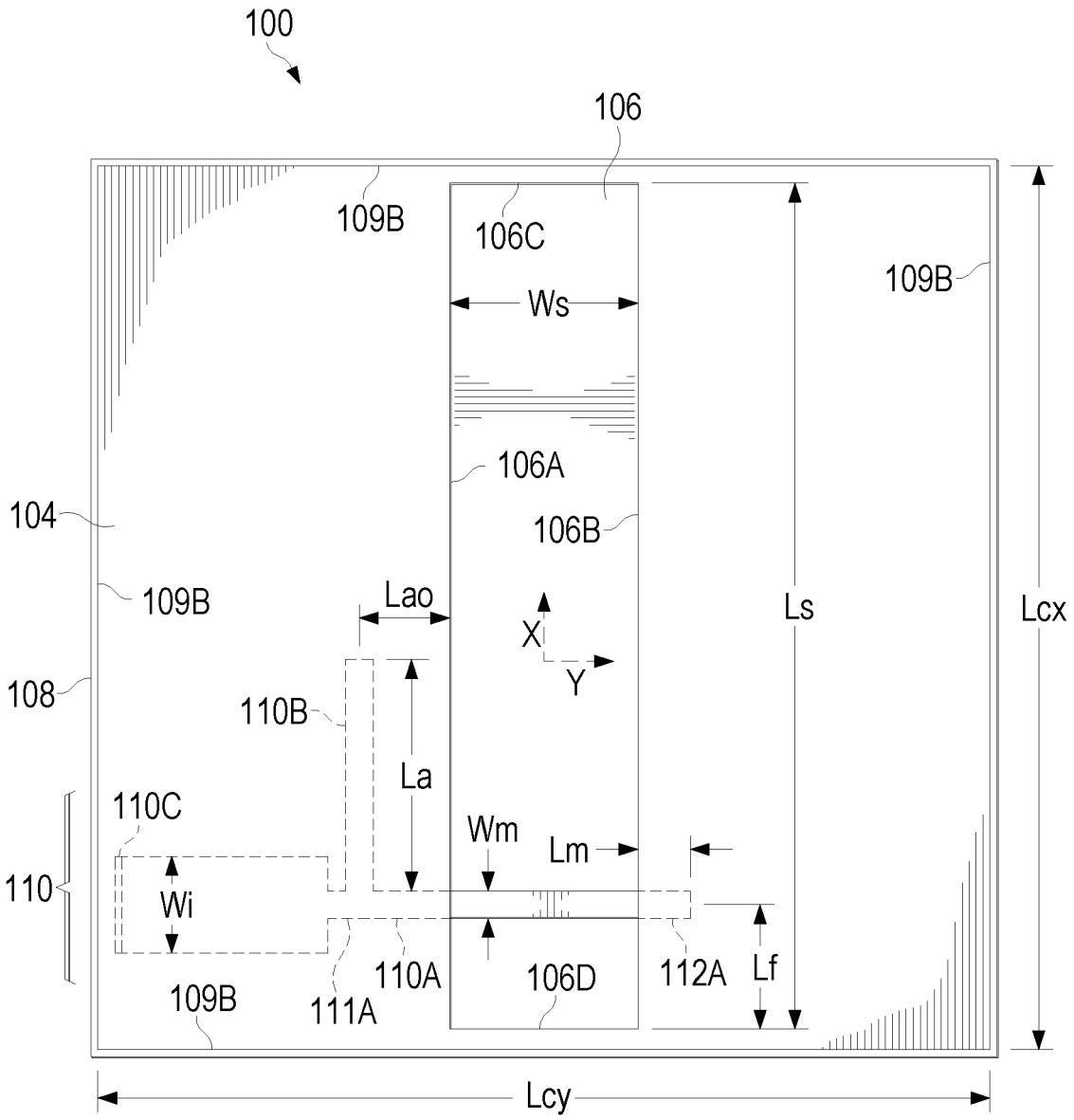
FIG. 1A illustrates a top view of a single polarized antenna element according to an embodiment of the present invention.

The following description describes single and dual polarized dual-resonant cavity backed slot antenna (D-CBSA) elements. In the following description, numerous specific details are set forth in order to provide a more thorough understanding of the present invention. It will be appreciated, however, by one skilled in the art that the invention may be practiced without such specific details. Those of ordinary skill in the art, with the included descriptions, will be able to implement appropriate functionality without undue experimentation.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Bracketed text and blocks with dashed borders (e.g., large dashes, small dashes, dot-dash, and dots) may be used herein to illustrate optional operations that add additional features to embodiments of the invention. However, such notation should not be taken to mean that these are the only options or optional operations, and/or that blocks with solid borders are not optional in certain embodiments of the invention.

In the following description and claims, the terms "coupled" and "connected," along with their derivatives, may be used. It should be understood that these terms are not intended as synonyms for each other. "Coupled" is used to indicate that two or more elements, which may or may not be in direct physical or electrical contact with each other, co-operate or interact with each other. "Connected" is used to indicate the establishment of communication between two or more elements that are coupled with each other.

Typically, an antenna element comprises an arrangement of components, electrically connected to a receiver or transmitter. The antenna element can be part of a radio wave transmitting unit that is operative to transmit a radio wave (i.e., electromagnetic field wave). An oscillating current of electrons forced through the antenna element by a transmitter via a feeding point creates an oscillating magnetic field around the components of the antenna element. At the same time, the charge of the electrons also creates an oscillating electric field along the components. These time-varying fields radiate away from the antenna element into space as a moving transverse electromagnetic field wave. Conversely, the antenna element can be part of a radio wave receiving unit that is operative to receive a radio wave. During reception, the oscillating electric and magnetic fields of an incoming radio wave exert force on the electrons in the components of the antenna element. This force causes the electrons to move back and forth, creating oscillating currents in the antenna element, which are collected via the feeding element. These currents are fed to a receiver to be amplified.

The embodiments disclosed herein pertain to slot antennas. Furthermore, while some of the description below is provided in reference to the antenna elements being part of radio wave transmitting units, a person skilled in the art would readily understand the described concepts as applicable to antenna elements being part of radio wave receiving units.

Embodiments of a single and dual polarized dual-resonant cavity backed slot antenna (D-CBSA) elements are described. In some embodiments, the antenna element comprises a housing having a base and a conducting plate. The housing has a cavity formed between the base and the conducting plate. The cavity is coupled to the conducting plate at an upper edge of the housing. The conducting plate has a radiating slot with a length and a width that extends longitudinally along a first axis and a second axis, respectively. The slot has a first and a second edge along the first axis. The antenna element includes a feeding element having a feeding point, a feeding line, and a stub. The feeding element is located in the cavity at a first predetermined distance between the base and the conducting plate for enabling dual resonant frequency impedance matching. The feeding line extends along the second axis of the conducting plate across the width of the radiating slot such that a first end of the feeding line is coupled with the feeding point on one side of the radiating slot, adjacent the first edge of the radiating slot and a second end of the feeding line extends past the second edge of the radiating slot, and the stub extends laterally of the feeding line.

In the embodiments described herein the feeding element of the antenna element is located inside the cavity with no dielectric material on top of the radiating slot. Thus, as opposed to existing slot antennas with a feeding element on top of the radiating slot, the present embodiments do not face the issue of surface and reflected waves. Further, the bandwidth of the antenna element is increased by matching at two resonant frequencies. The dual frequency matching is achieved by the feeding element located inside the cavity and which includes the feeding line extending across the radiating slot as well as the stub. In particular, an extension of the feeding line past the radiating slot acts as a tuning stub and excites the slot at a first resonant frequency. Further, and in contrast with known prior art slot antenna designs, the stub that is part of the feeding element allows for impedance matching at a second resonant frequency. In addition, the stub (which may be referred to as a matching stub) is located inside the cavity minimizing, thereby, the associated element size and loss as well as maximizing the matching bandwidth. Some embodiments have a dual polarized radiating slot (i.e., including two separate feeding elements) with differential feed structure. In some embodiments, the antenna element may include active and passive feeding elements. In some embodiments, the antenna elements have a bandwidth larger than 11% (at 10 dB return loss).

As it will be discussed in further details below, the embodiments of the antenna elements described herein present several advantages when compared to existing slot antennas. For example, as a result of the omission of dielectric material on top of the slot radiator (which ensures that no surface and reflected waves are present) scan blindness is avoided. The antenna elements of the various embodiments achieve a large impedance bandwidth (e.g., 11% at 10 dB return loss), with well-behaved radiation patterns that have similar beam widths in the E-plane and in the H-plane over this bandwidth.

Figure 1B:
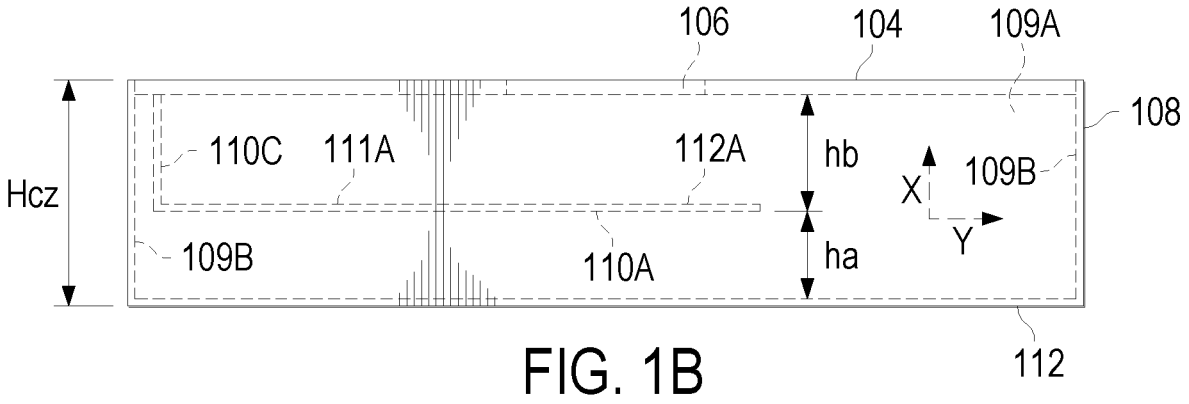
FIG. 1B illustrates a side view of a single polarized antenna element according to an embodiment of the present invention.
Figure 1C:
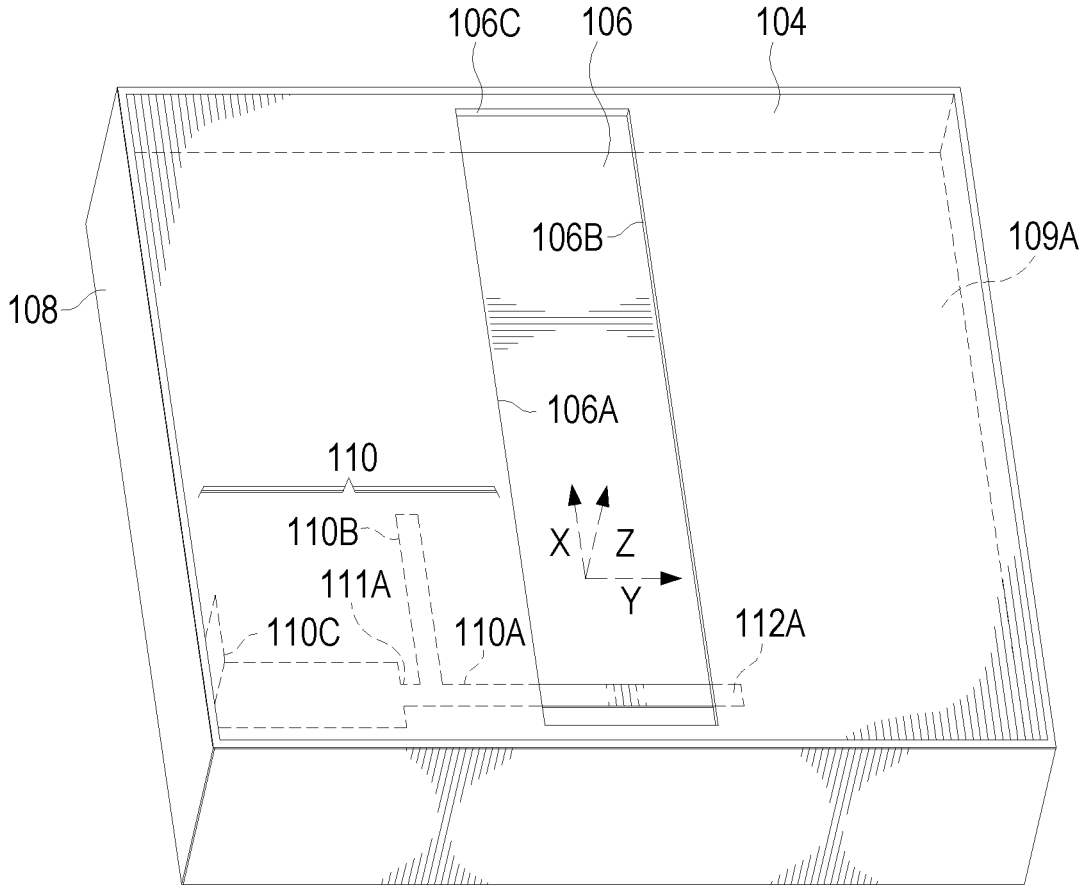
FIG. 1C illustrates an elevation view of a single polarized antenna element according to an embodiment of the present invention.

FIGS. 1A-C illustrates various views of a single polarized dual-resonant cavity backed slot antenna (D-CBSA) according to an embodiment of the present invention. FIG. 1A illustrates a top view of an antenna element 100; FIG. 1B illustrates a side view of the antenna element 100; and FIG. 1C illustrates an elevation view of the antenna element 100.

The antenna element 100 includes a conducting plate 104, a housing 108, and a feeding element 110. The conducting plate 104 has a first axis X and a second axis Y. The conducting plate 104 defines a radiating slot 106 that that has a length Ls and extends longitudinally along the first axis X and a width Ws that extends laterally along the second axis Y. The radiating slot 106 is an opening in the conducting plate 104. The radiating slot 106 has a first edge 106A and a second edge 106B along the first axis X. The radiating slot has a third 106C and a fourth edge 106D along the second axis Y. While the radiating slot is illustrated as a rectangular opening in the conducting plate 104, in other embodiments the radiating slot may have different shapes (e.g., a concave bisymmetric hexagon (bow tie), trapezoid, a convex polygon (such as convex octagon), circular, or other shapes can be used). The distance between the first edge 106A and the second edge 106B is the width of the slot Ws. The distance between the third edge 106C and the fourth edge 106D is the length of the slot Ls.

The housing 108 has a cavity 109A formed therein. The housing 108 is formed of walls 109B and a base 112. The conducting plate 104 is coupled to the housing at upper edges of the housing 108 (e.g., at upper edges of the walls 109B). The cavity has a $L_{cx}$, length (in the direction of the X axis) and $L_{cy}$, width (in the direction of the Y axis) and $H_{cz}$ height (in the direction of the Z axis). The feeding element 110 is located in the cavity 109A at a first predetermined distance $h_b$ from the conducting plate and a second predetermined distance $h_a$ from the base 112 of the housing 108 for enabling dual frequency impedance matching. In some embodiments, the feeding element 110 is located at the center of the slot height (i.e., the distance $h_b$ is equal or substantially equal to the distance $h_a$). The feeding element 110 includes a feeding line 110A extending along the second axis Y of the conducting plate 104 and across the radiating slot 106 such that a first end 111A of the feeding line 110A is coupled with a feeding point 110C on one side or before the first edge 106A of the radiating slot 106 and a second end of the feeding line 110A on the other side, extending past the second edge 106B of the radiating slot 106. The offset location $L_f$ indicates the location of the feeding line 110A with reference to the fourth edge 106D of the radiating slot 106. The length $L_m$ indicates the length of a portion of the feeding line 110A that extends past the second edge 106B of the radiating slot 106.

The feeding element 110 includes a stub 110B extending laterally from the feeding line 110A. In some embodiments, the stub 110B is coupled with the feeding line 110A at a location that is between the first end 111A of the feeding line and the first edge 106A of the radiating slot 106. The distance from the stub to the first edge 106A of the radiating slot is defined as Lao. In other embodiments, the stub 110B is coupled to the feeding line 110A at other locations different from the location illustrated in FIGS. 1A-C without departing from the scope of the present invention. While the stub 110B is shown as being on one side of the feeding line 110A along the X-axis and on the same plane as the feeding line 110A, in other embodiments, the stub 110B can located at different locations and planes. In some embodiments, the stub can be located below or above the feeding line (i.e., not in the same plane) and connected to the feeding line by a via. For example, when the antenna element is a PCB structure, the stub can be located at another layer different from the layer in which the feeding line is (e.g., at a layer that is below or under the layer of the feeding line). In some embodiments, the stub can also be slanted to the feeding line (i.e., forming an angle with the feeding line that is different than 90 degrees). In some embodiments, the stub can be on either side (positive x-direction or negative x-direction) of the feeding line.

In operation, feeding element 110 allows coupling of an oscillating current to the antenna element 100, via the feeding point 110C. When the antenna element 100 is part of a transmitting unit, the feeding element 110 is the component of the antenna element which receives the oscillating current from a transmitter (not illustrated) through the feeding point and feeds it to the rest of the antenna structure (e.g., the cavity and the radiating slot). In these embodiments, the antenna element is to operate as part of a radio wave transmitting unit and the feeding element is to feed radio frequency current received from the transmitter through the feeding point 110C to the cavity and radiating slot to be radiated as radio waves. When the antenna element 100 is part of a receiving unit, the feeding element 110 is the component that collects the incoming radio waves, converts them to electric currents and transmits them to a receiver (not illustrated). In these embodiments, the antenna element is to operate as part of a radio wave receiving unit and the feeding element 110 is to transform radio waves in the cavity and radiating slot to radio frequency current to be transmitted to the receiver through the feeding point 110C.

The antenna element 100 includes in addition to the feeding element 110, a reflecting and directive structure, represented here as the cavity 109A and the radiating slot 106, whose function is to form the radio waves from the feed into a beam or other desired radiation pattern. The cavity 109A serves two main purposes. It reduces the possibility of surface wave propagation and creates a unidirectional radiation pattern of the radio wave. The cavity has a dielectric low loss PCB material in it. The relative permittivity value of the dielectric material has an effect on the resonant frequency and size of the element. The base 112, which can also act as a ground plane for cavity 109A eliminates backside radiation.

The center frequency of the electromagnetic wave radiated by the antenna element 100 is mainly determined by the slot length $L_s$ as well as by the cavity dimensions $L_{cx}$, and $L_{cy}$ and relative permittivity of the dielectric material in the cavity. The width $W_m$ and height $h_a$ of the feeding line 110A determines the impedance $Z_m$ of the feeding line 110A across the radiating slot 106. The feeding line's impedance $Z_m$ is matched to the slot impedance by selecting an appropriate offset location $L_f$. The parameters $L_m$, $L_a$ and $L_{ao}$ and $L_f$ determine the spacing between the resonant frequencies and enables impedance matching at these resonant frequencies. In the embodiments, where the feeding element 110 is placed in the center of the cavity's height, i.e., along the axis Z, the sensitivity of the characteristics of the antenna element (e.g., the impedance and the radiation pattern of the antenna element) to the parameters of the feeding element 110 is reduced. Thus, the proposed antenna element is less sensitive to manufacturing tolerance variations of components when the feed element is placed at approximately half of the cavity height.

In operation, the extension of the feeding line 110A that extends past the edge 106B of the radiating slot 106 acts as a tuning stub and excites the radiating slot 106 at a first resonant frequency. Further, and in contrast with known prior art slot antenna designs, the stub 110B that is part of the feeding element 110 allows for impedance matching at a second resonant frequency. The matching stub 110B is located inside the cavity thereby minimizing the loss as well as maximizing the matching bandwidth. The center operating frequency of the antenna element can be determined by selecting appropriate parameters for the different components of the antenna element (e.g., parameters of the slot, the cavity and the feeding elements). An exemplary of the radio wave transmitted by the antenna element 100, the center frequency can be 27 GHz or 28 GHz with a bandwidth of 11%.

Figure 2:
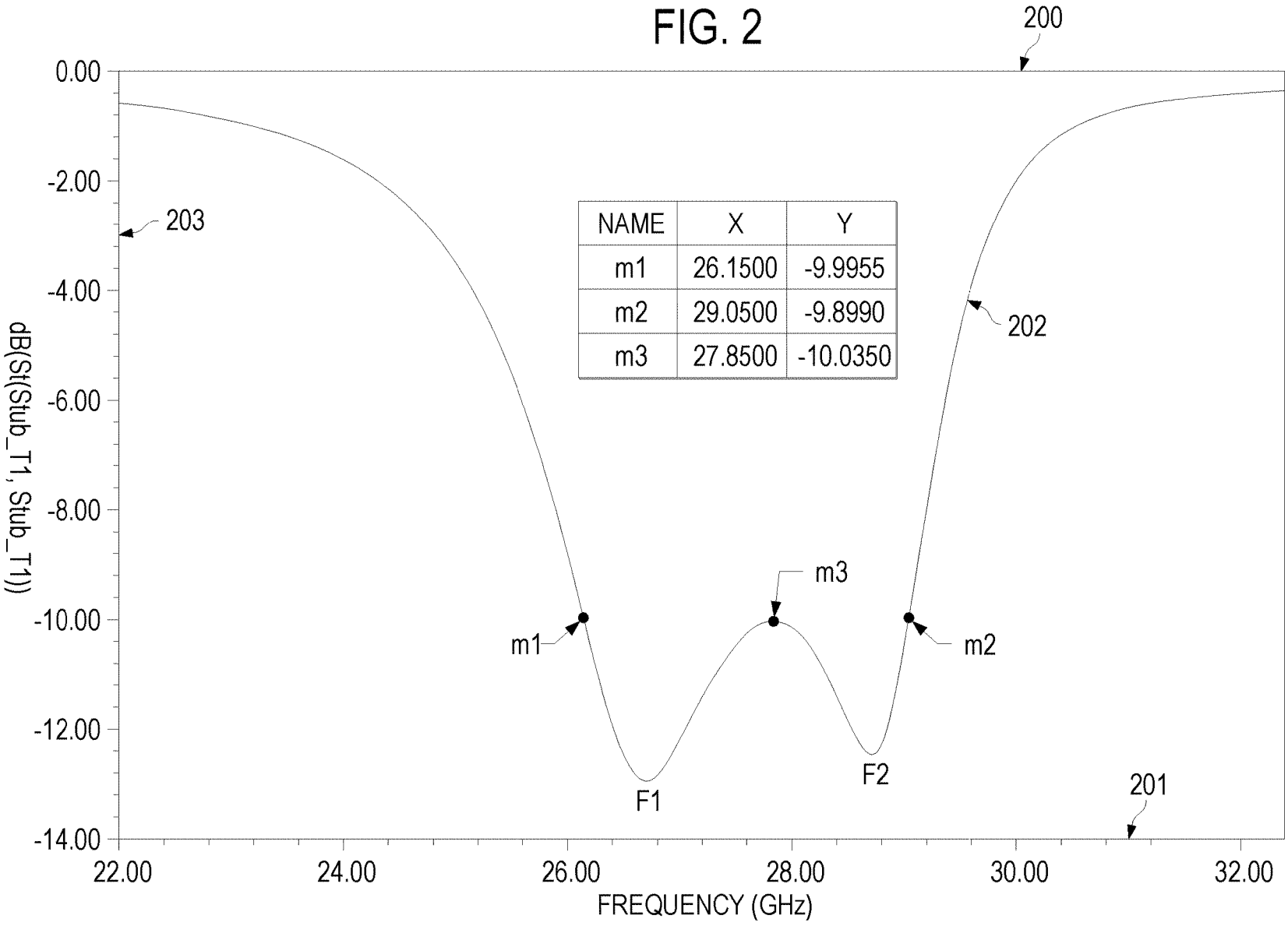
FIG. 2 illustrates exemplary simulation results of return loss associated with an exemplary embodiment of an antenna element.

FIG. 2 illustrates exemplary simulation results of return loss associated with an exemplary embodiment of an antenna element. The plot 200 illustrates a simulation of return loss for the single polarized antenna element 100 of FIGS. 1A-C.

A return loss is a measurement of the impedance matching characteristics of the antenna element. A poorly matched antenna will reflect RF energy which will not be available for transmission or radiated energy and will instead end up at the transmitter. The energy returned to the transmitter distorts the signal and affects the efficiency of the transmitted power and the coverage area of the antenna. The return loss 202 measured in decibel (dB) (axis 203) is illustrated in FIG. 2 as a function of the frequency measured in gigahertz (GHz) (axis 201). The illustrated return loss 202 is achieved when the antenna element is designed with optimum parameters, where the center frequency of the antenna element is 27 GHz. For example, the following measurements can be used for the different components of the antenna element: Lf=600 um, Lm=230 um, La=1130 um, Wm=128 um, Ls=4100 um, Ws=900 um, Lcx=4300 um, Lao=436 um, Wi=450 um, ha=437 um, hb=508 um, and Hcz=962 um (um referring to micrometer). These measurements are intended to be exemplary only and are not limitative. The two resonant frequencies of the antenna element can be seen at F1 and F2. The points m1, m2, and m3 illustrate frequencies that achieve a return loss of −10 dB.

In some embodiments, the slot width, as measured along the y-axis, is chosen to control the radiation pattern behavior (e.g., the bandwidth and symmetry of the radiation pattern), in particular the slot's width is selected to obtain an increased symmetry in radiation patterns. In prior art antenna element designs a wider radiating slot allows for a wider bandwidth, however a slot that is too wide causes asymmetry of the radiation pattern. The embodiments of the present invention, by matching at two resonant frequencies, allows for the selection of a less wide slot to obtain the same bandwidth as one that would have been obtained with a wider slot in prior art designs while still maintaining the symmetry of the radiation pattern. In contrast, prior art designs of slot antenna elements would have required a wider slot to obtain the same bandwidth of the radiation pattern consequently causing an asymmetry of the radiation pattern. Thus, the embodiments presented herein present clear advantages when compared with prior slot antenna designs.

Figure 3A:
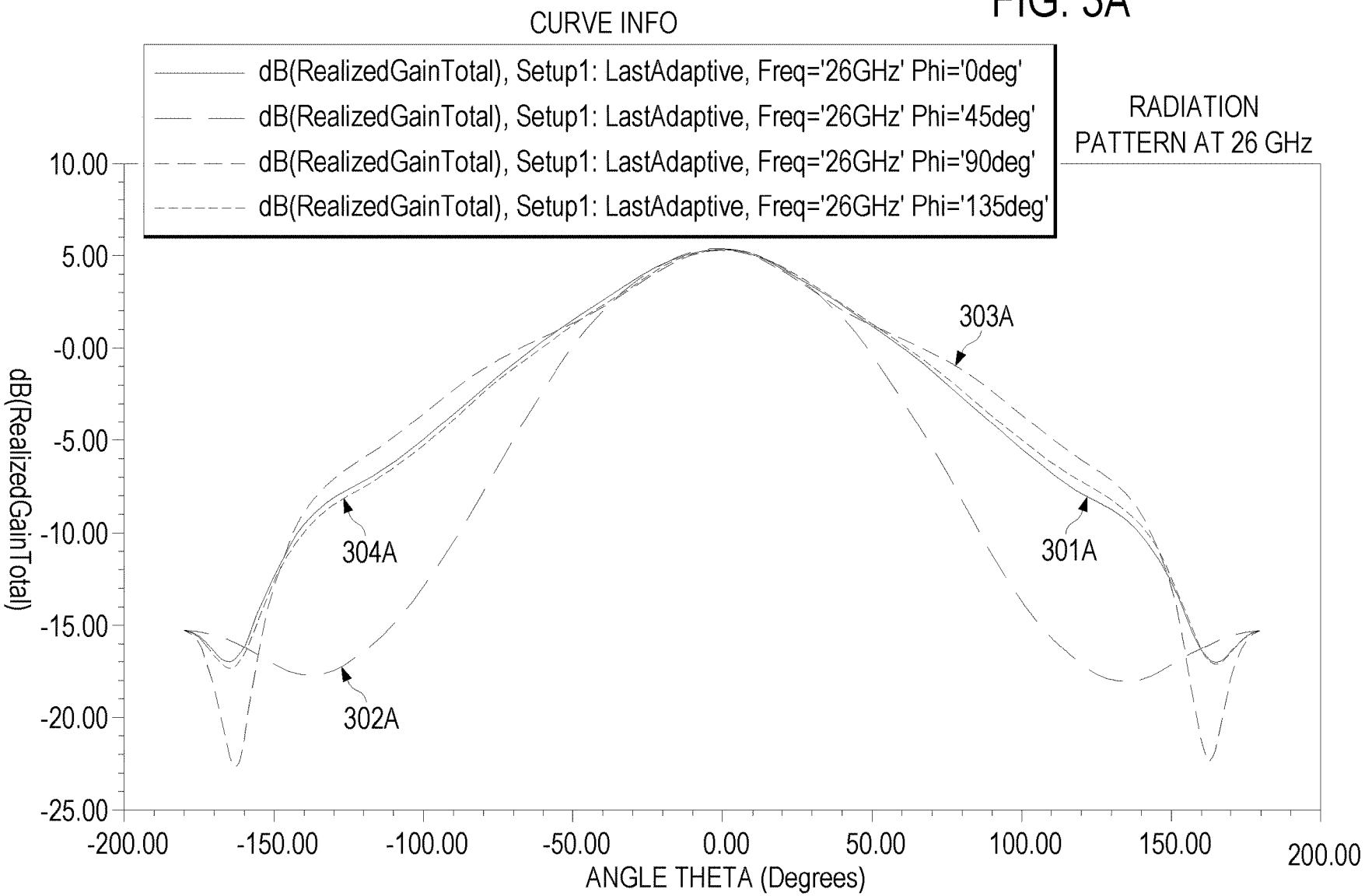
FIG. 3A illustrates exemplary simulation results of a radiation pattern at a frequency of 26 GHz associated with an exemplary embodiment of a single polarized antenna element.

FIG. 3A illustrates exemplary simulation results of a radiation pattern associated with an exemplary embodiment of a single polarized antenna element. For example, FIG. 3A illustrates a graphical representation of the radiation properties of the antenna as a function of space (e.g., as a function of an angle theta measured in degrees). The curves 301A, 302A, 303A, and 304A show the radiation pattern in four angular cuts (e.g., Phi=0 degrees, Phi=45 degrees, Phi=90 degrees, and Phi=135 degrees respectively) of a single polarized antenna element as defined by the present invention (e.g., antenna element 100) when radiating at a center frequency of 26 GHz. The curves 301A-304A describe how the antenna radiates energy out into space. The curves show that the antenna element 100 has generally well-behaved radiation patterns in different planes.

Figure 3B:
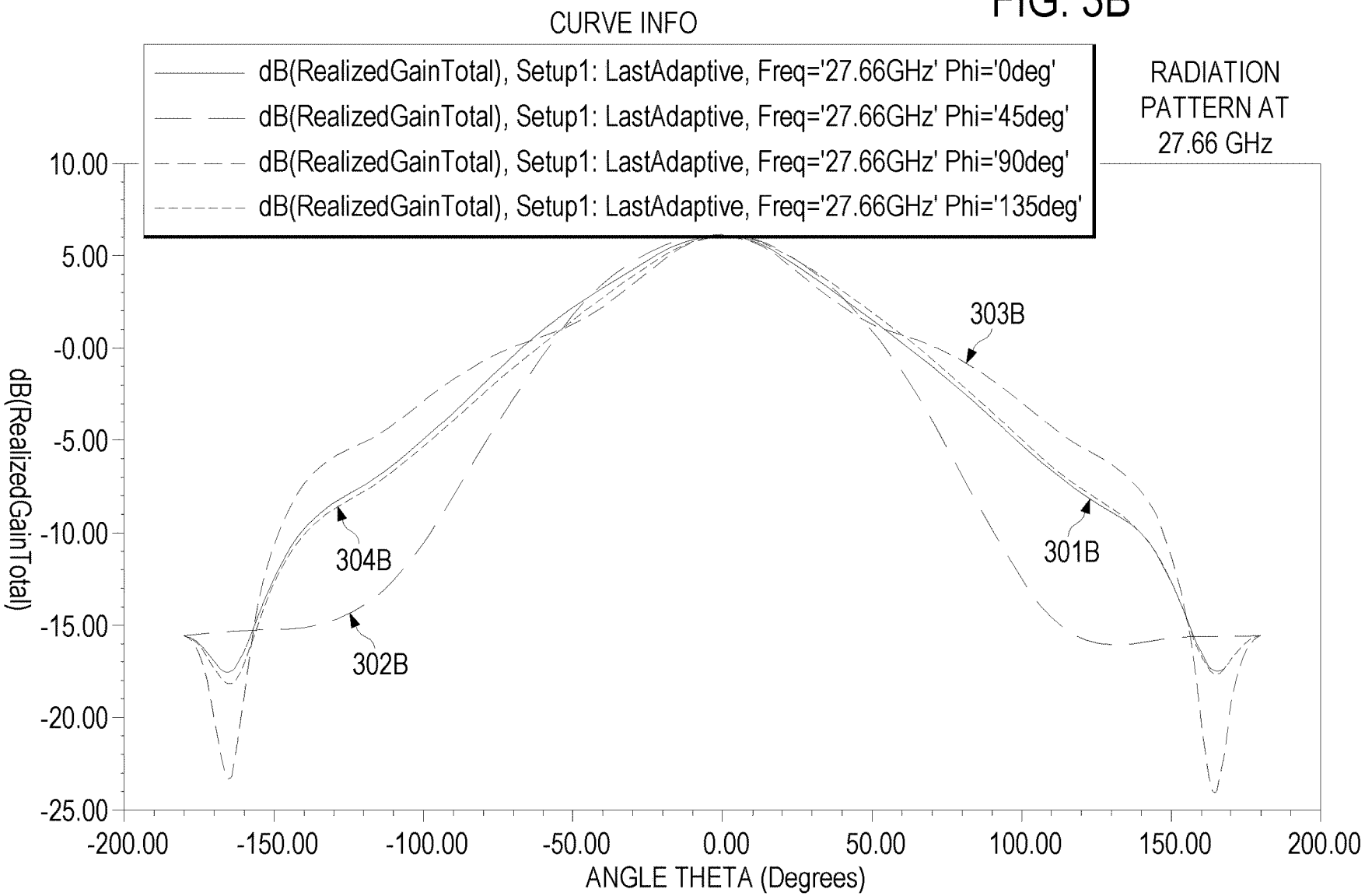
FIG. 3B illustrates exemplary simulation results of a radiation pattern at a frequency of 27.66 GHz associated with an exemplary embodiment of a single polarized antenna element.

FIG. 3B illustrates exemplary simulation results of a radiation pattern associated with an exemplary embodiment of a single polarized antenna element. For example, FIG. 3B illustrates a graphical representation of the radiation properties of the antenna as a function of space (e.g., as a function of an angle theta measured in degrees). The curves 301B, 302B, 303B, and 304B show the radiation pattern in four angular cuts (e.g., Phi=0 degrees, Phi=45 degrees, Phi=90 degrees, and Phi=135 degrees respectively) of a single polarized antenna element as defined by the present invention (e.g., antenna element 100) at a center frequency of 27.66 GHz. The curves 301B-304B describe how the antenna radiates energy out into space. The curves show that the antenna element 100 when radiating at a center frequency of 27.66 GHz has generally well-behaved patterns. As shown in FIGS. 3A-B, the embodiments of the present invention present antenna elements with radiation patterns that are well behaved and have similar beam widths in different radiation planes.

Figure 4:
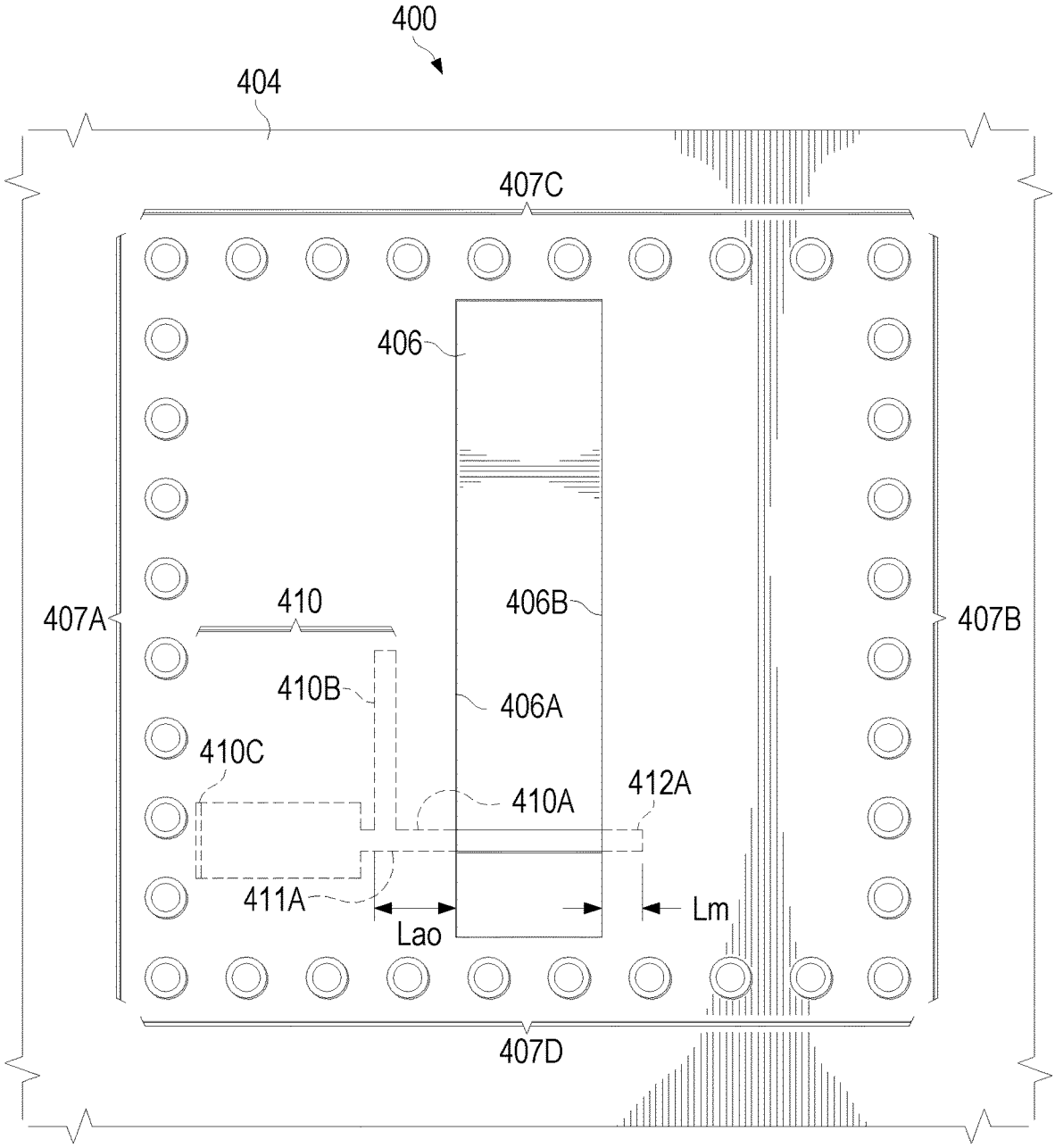
FIG. 4 illustrates a top view of a single polarized antenna element according to an embodiment of the present invention.

FIG. 4 illustrates a top view of an antenna element according to another embodiment of the present invention. The antenna element 400 is a single polarized cavity backed slot antenna realized by multilayer printed circuit board (PCB) structure. The housing of the antenna element 400 has a base with a ground plane (not shown), an upper ground plane or conducting plate 404 and includes multiple rows (row 407A, row 407B, row 407C, and row 407D) of vias coupled to a lower ground plane. The vias connect the upper and the lower ground planes (e.g., upper ground plane 404 that defines the radiating slot 406). In this embodiment, the vias 407 replace the cavity walls of the housing (108 see FIG. 1). Typically, the vias are spaced apart at a distance of less than or equal to 0.1 wavelength at the highest frequency. The lower and upper ground planes are conducting plates. For the purpose of this description and reference to the drawings, the lower ground plane is sometimes referred to as a base. In some embodiments, the conducting plates are made of copper material and the cavity is a dielectric material between the two conducting plates. The radiating slot 406 is etched at the upper ground plane 404. The feeding element 410 is a stripline located in the middle layer of the PCB structure.

The feeding element 410 of the antenna element 400 includes a feeding line 410A, a stub 410B, and a feeding point 410C. The feeding element 410 is located in the cavity at a first predetermined distance from the conducting plate and a second predetermined distance from the lower ground plane (i.e., the base of the housing). The feeding element 410 enables dual frequency impedance matching through the feeding line 410A that extends across the slot with a given distance $L_m$ from the second edge 406B of the slot and the stub 410B. In some embodiments, the stub 410B is coupled with the feeding line 410A at a location that is between the first end 411A of the feeding line and the first edge 406A of the radiating slot 406 defining a distance Lao from the stub to the first edge 406A of the radiating slot. In other embodiments, the stub 410B is coupled to the feeding line 410A at other locations that are outside the slot and which are different from the location illustrated in FIG. 4 without departing from the scope of the present invention. In some embodiments, the feeding element 410 is located at the center of the slot height or mid-way between the base (112 in FIG. 1) or lower ground plane and upper ground plane 404.

Figure 5:
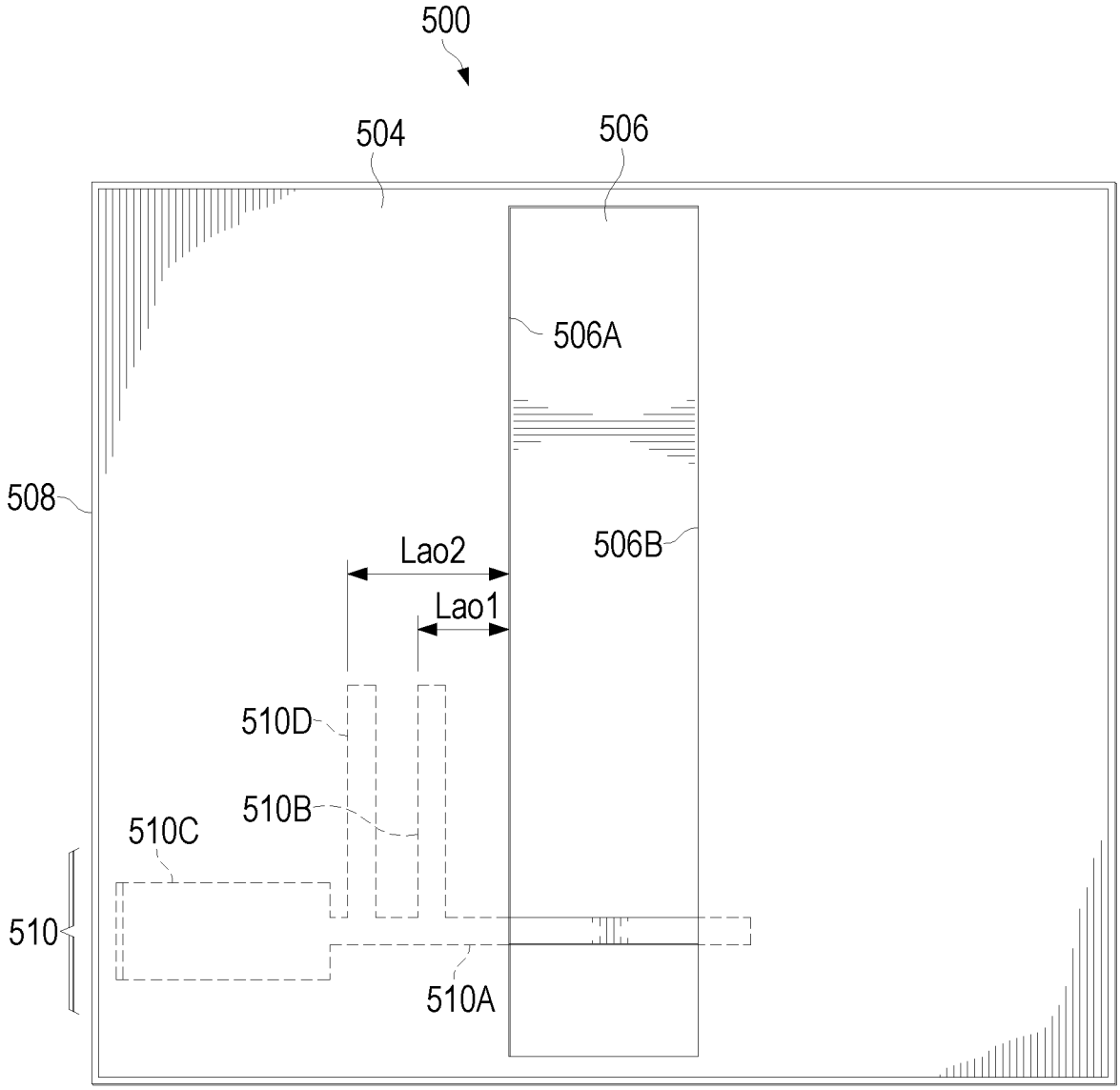
FIG. 5 illustrates a top view of a single polarized antenna element according to an embodiment of the present invention.

FIG. 5 illustrates a top view of an antenna element according to another embodiment of the present invention. This alternative embodiment provides an example of an antenna element 500 in which the feeding element 510 includes more than one stub. The feeding element 510 includes the feeding line 510A, the feeding point 510C, and the feed stubs 510B and 510D. While this example illustrates a first and a second stub (510B and 510D) this is intended to be exemplary only. Other embodiments can include multiple numbers of stubs with varying shapes without departing from the scope of the present invention. Having multiple stubs and/or varying shapes allows to obtain an increased bandwidth and/or improved return loss for a given bandwidth. In addition, the location of the stub(s) can vary along the feeding line and the illustrated locations (e.g., FIGS. 1A-C, FIGS. 4-6, FIGS. 8-9A, FIGS. 10-11) is exemplary only.

Figure 6:
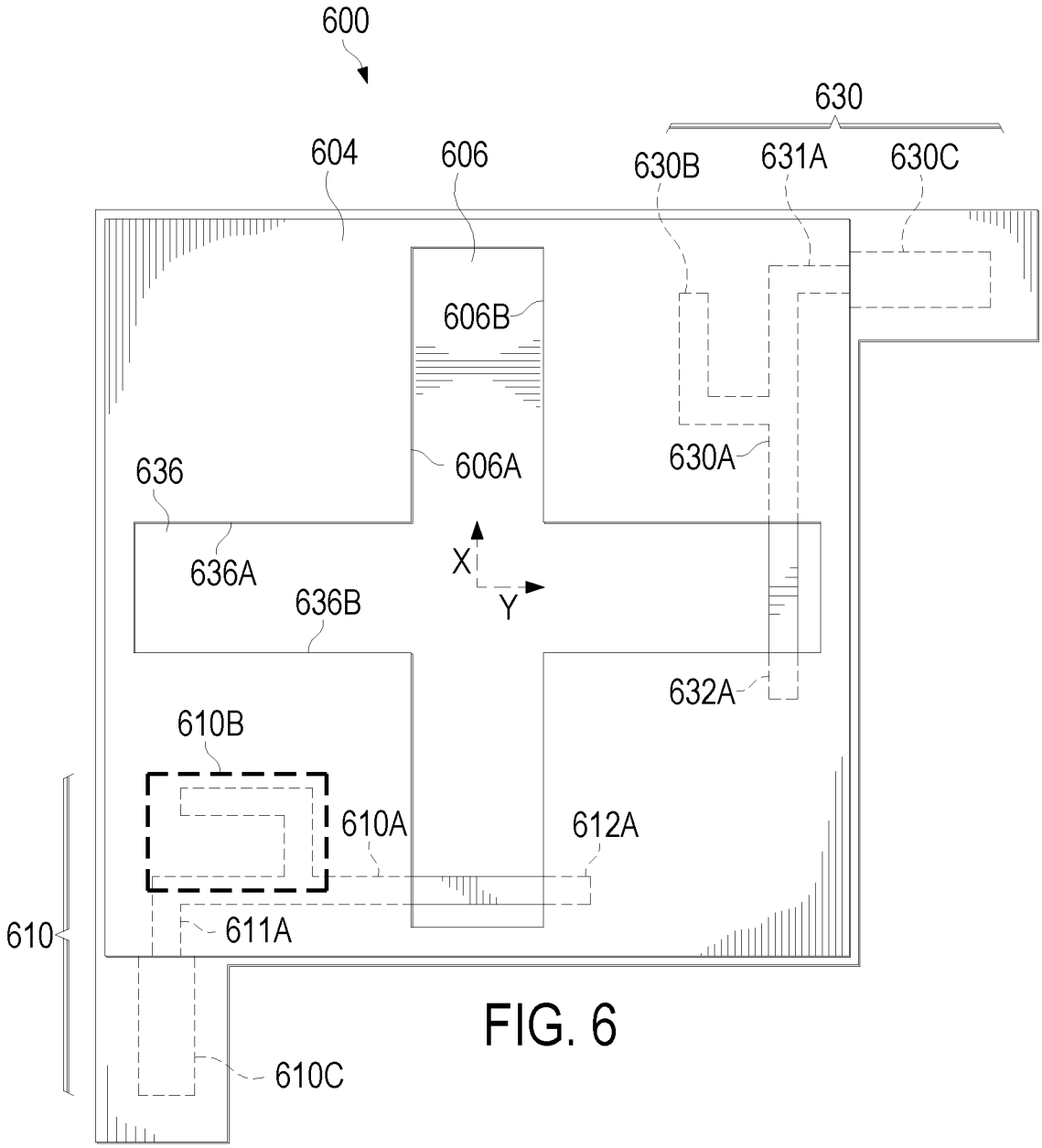
FIG. 6 illustrates a top view of a dual polarized antenna element according to an embodiment of the present invention.

FIG. 6 illustrates a top view of a dual polarized antenna element according to an embodiment of the present invention. The antenna element 600 is a dual polarized antenna element. The antenna element 600 includes two radiating slots at a right angle of one another. The first slot 606 is oriented perpendicularly to the second slot 636. The first radiating slot 606 extends longitudinally along the X axis, while the second radiating slot 636 extends longitudinally along the Y axis which is perpendicular to the X axis. The first radiating slot 606 is polarized with a first feeding element 610. The second radiating slot 636 is polarized with a second feeding element 630.

The feeding element 610 is located inside the cavity and includes a feeding line 610A extending along the Y axis of the conducting plate 604 and across the first radiating slot 606 such that a first end 611A of the feeding line 610A is coupled with a feeding point 610C before the first edge 606A of the radiating slot 606 and a second end 612A of the feeding line 610A is located after the second edge 606B of the radiating slot 606. The portion of the first feeding line 610A that extends past the second edge 606B of the first slot 606 acts as a tuning stub and excites the first radiating slot 606 at a first resonant frequency. The first feeding element 610 includes a first stub 610B coupled to the feeding line 610A. The first stub 610B allows for impedance matching at a second resonant frequency. In some embodiments, the stub 610B is coupled with the feeding line 610A at a location that is between the first end of the feeding line and the first edge 606A of the radiating slot 606 defining a predetermined distance from the stub to the first edge 606A of the radiating slot. In other embodiments, the stub 610B is coupled to the feeding line 610A at other locations different from the location illustrated in FIG. 6 without departing from the scope of the present invention.

The second feeding element 630 is located inside the cavity and includes a feeding line 630A extending along the X axis of the conducting plate 604 and across the second radiating slot 636 such that a first end 631A of the second feeding line 630A is coupled with a feeding point 630C at the first edge 636A of the radiating slot 636 and a second end 632A of the second feeding line 630A extends past the second edge 636B of the radiating slot 636. The second end 632A of the second feeding line 630A that extends past the second edge 636B of the second radiating slot 636 acts as a tuning stub and excites the second radiating slot 636 at a first resonant frequency. The second feeding element 630 includes a second stub 630B coupled to the second feeding line 630A. In some embodiments, the stub 630B is coupled with the feeding line 630A at a location that is between the first end 631A of the feeding line 630A and the first edge 636A of the second radiating slot 636 defining a distance from the stub to the first edge of the radiating slot. In other embodiments, the stub 630B is coupled to the feeding line 630A at locations other than those illustrated in FIG. 6 without departing from the scope of the present invention. The second stub 630B allows for impedance matching at a second resonant frequency. In some embodiments, the stubs 610B and 630B have an L shape, that is, they extend laterally of the feeding line, perpendicular thereof for a first portion of the stub and parallel to the feeding line for second portion of the stub. The L shape is used to prevent the stub end from getting too close to the slot. This illustrates another example of stub shapes that can be used in different embodiments of the antenna element. The exemplary L shape (or other shapes) of the stub 610B and 630B used for the dual polarized antenna element 600, may also be used for stubs of single polarized antenna elements.

Figure 7:
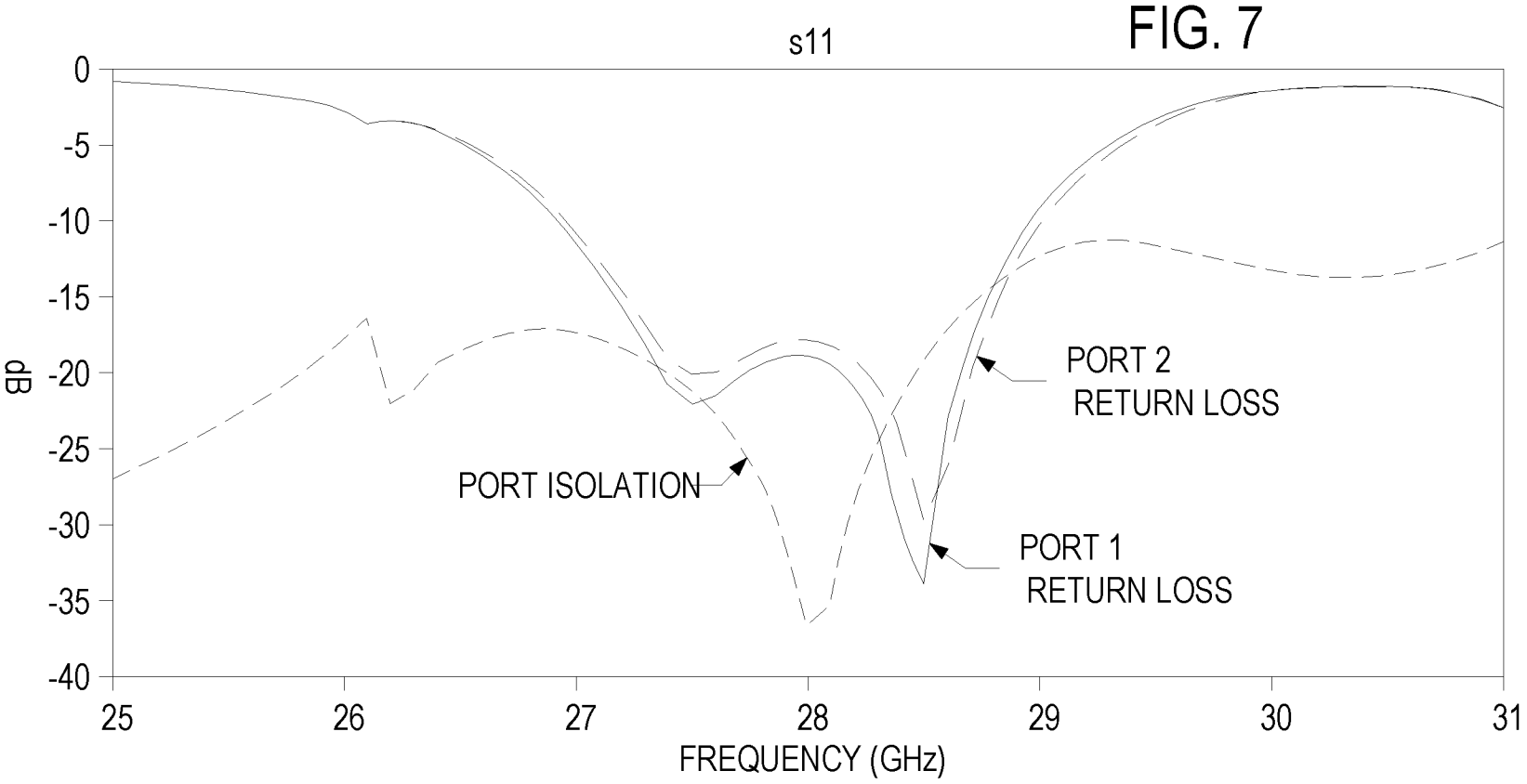
FIG. 7 illustrates exemplary simulation results of return loss associated with an exemplary embodiment of an antenna element.

FIG. 7 illustrates exemplary simulation results of return loss and port isolation associated with an exemplary embodiment of a dual polarized antenna element. In the illustrated example, the port isolation is larger than 12 dB over the 10 dB impedance bandwidth.

Figure 8:
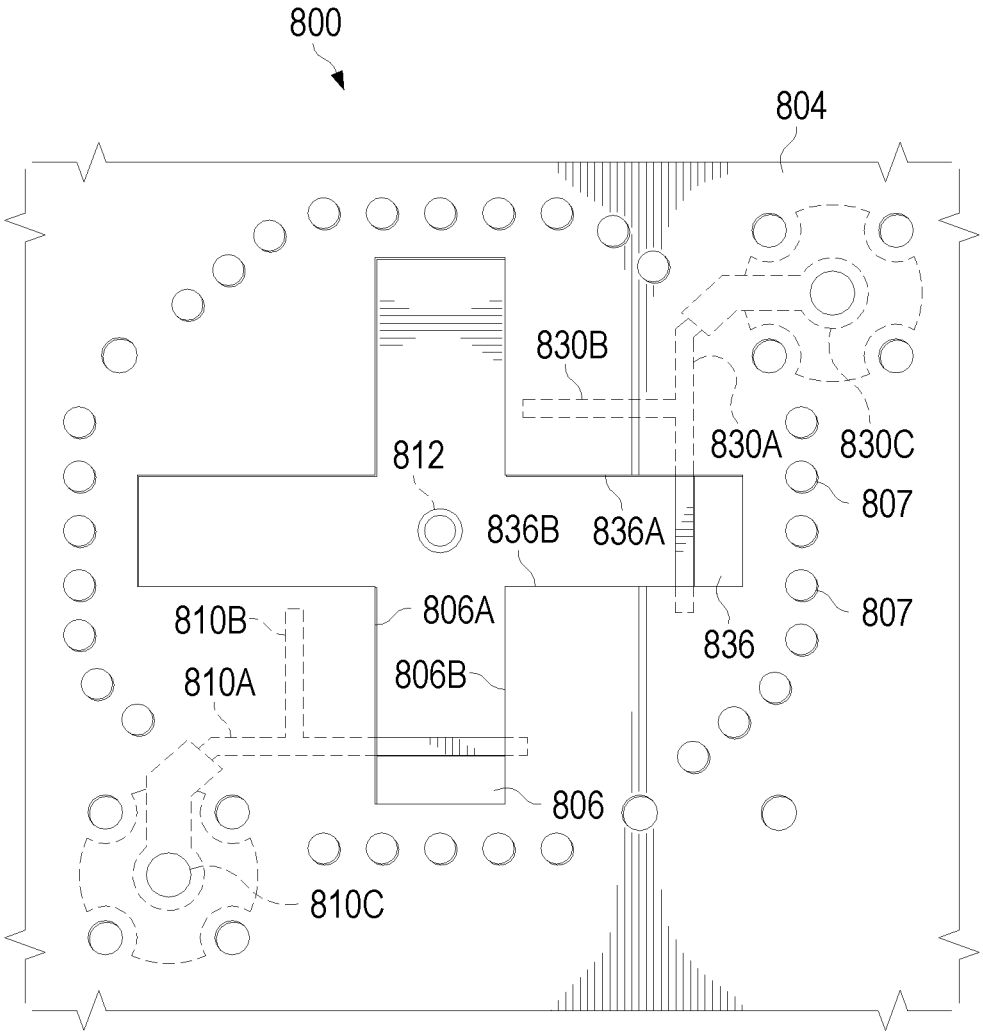
FIG. 8 illustrates a top view of a dual polarized antenna element according to an embodiment of the present invention.

FIG. 8 illustrates a top view of a dual polarized antenna element according to an embodiment of the present invention. In some embodiments, the shape of the housing created by the vias 807 define the cavity of the antenna element. The housing can take a different shape. For example, the housing can be an octagon. This shape creates space for a multi-layer radio frequency (RF) feeding element in an array configuration and can be used to efficiently combine multiple antenna elements in a single PCB structure.

In a cavity backed slot antenna element, an unwanted resonance that does not radiate any energy can exist at the radiated frequency. In some embodiments, a septum can be added to the antenna element to move the unwanted resonance outside the band of interest. The septum 812 is added to address the unwanted resonance. In some embodiments, the septum can be a via extending from the lower ground plane (i.e., extending from the base of the cavity) of the antenna element. In the embodiment of FIG. 8, a via is located at the center of the first and the second slot (such as element 812 in FIG. 8) which are laid out perpendicular to each other. In other embodiments, more than one vias can be added to the first slot 806 or the second slot 836 to act as a septum.

Figure 9A:
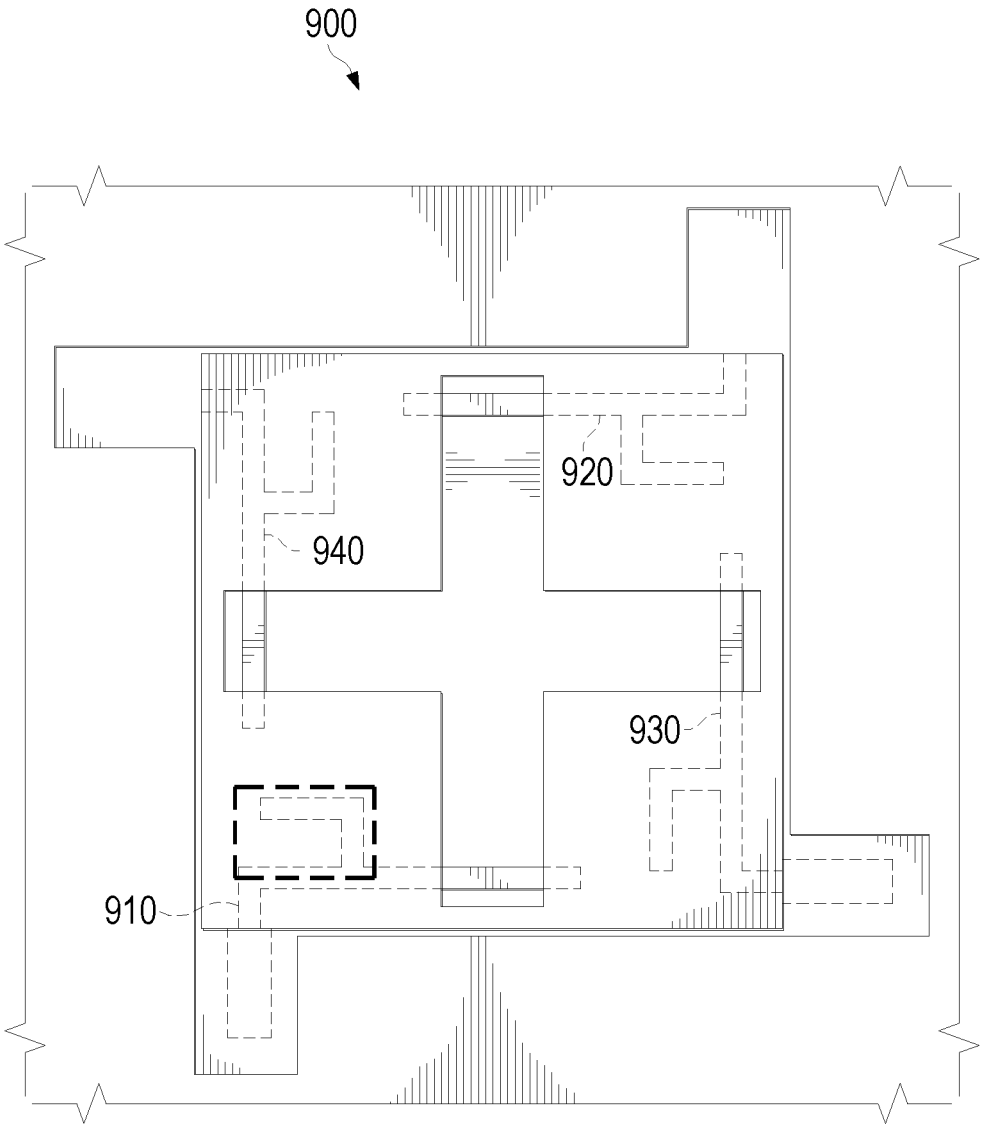
FIG. 9A illustrates a top view of a dual polarized antenna element according to an embodiment of the present invention.
Figure 9B:
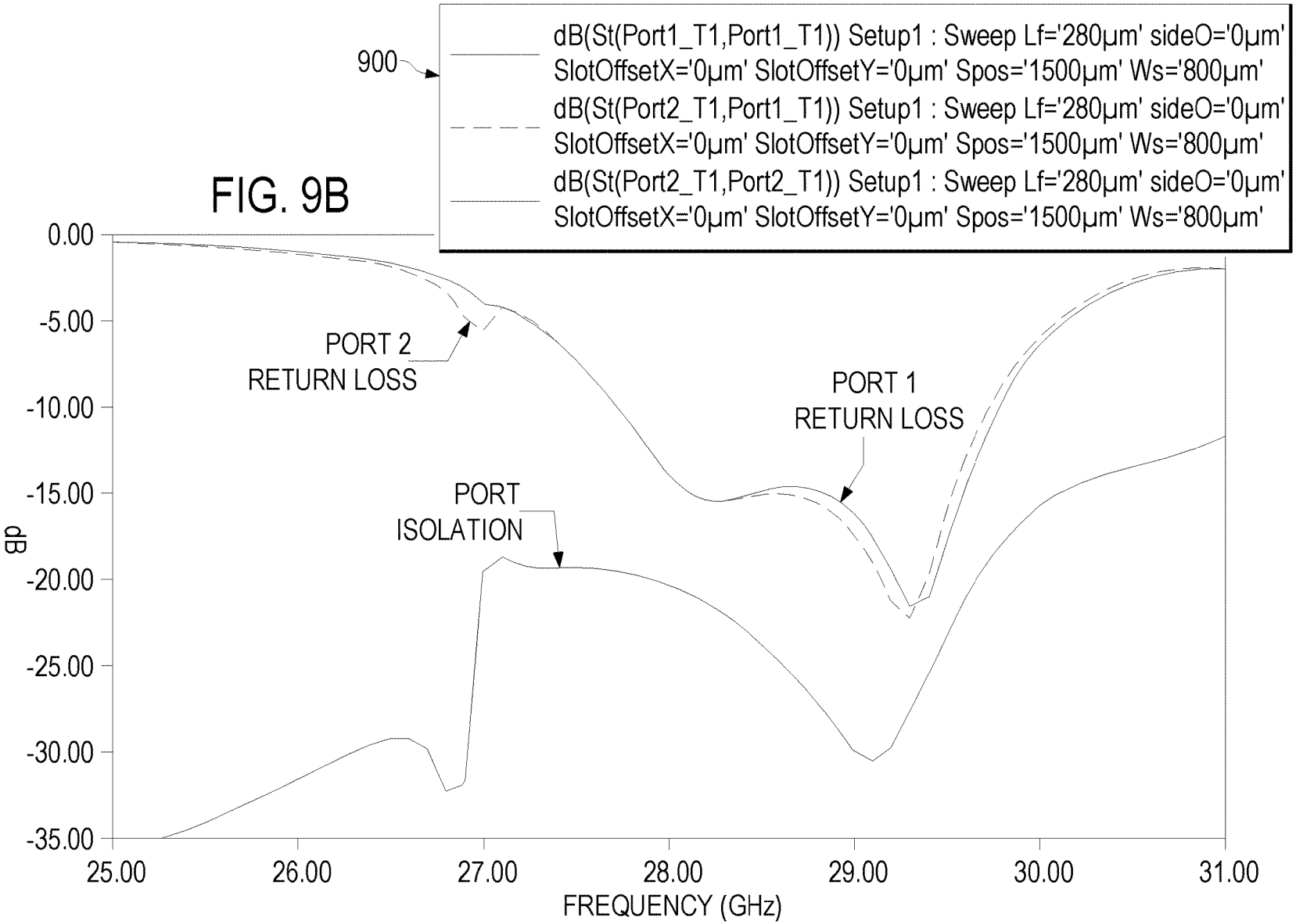
FIG. 9B illustrates exemplary simulation results of return loss associated with an exemplary embodiment of a dual polarized antenna element.
Figure 10:
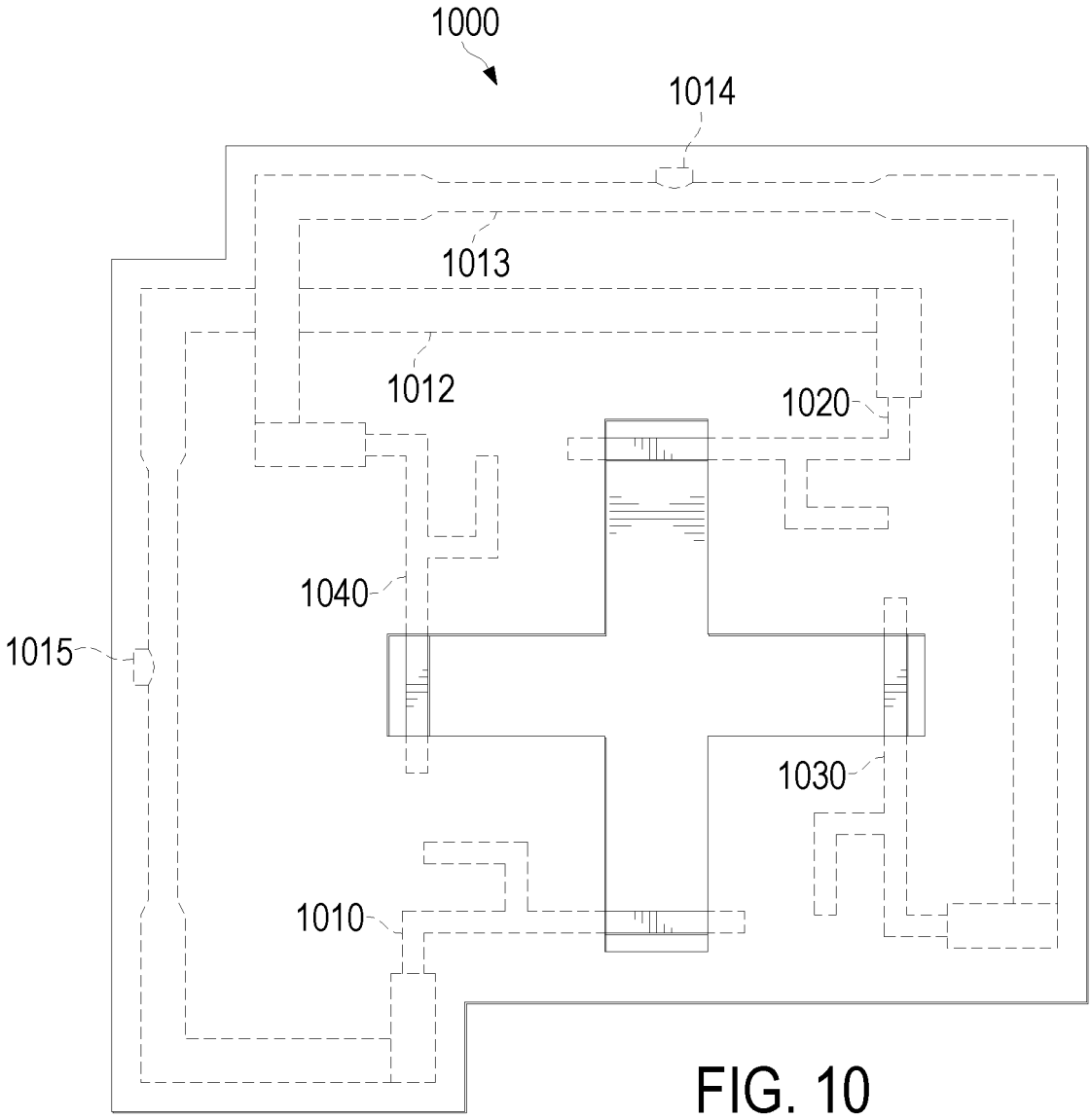
FIG. 10 illustrates a top view of a dual polarized antenna element according to an embodiment of the present invention.

Additional embodiments of dual polarized antenna elements are illustrated in FIGS. 9A and 10. FIG. 9A illustrates an exemplary dual polarized antenna element with an improved port isolation and cross polarization orthogonality according to one embodiment. The field symmetry and axial ratio of the radiated waves is improved by adding passive feeding elements (930 and 940) at the opposite ends of the radiating slots from the corresponding active feeding elements (910 and 930). As opposed to the active feeding elements that are to be connected to a signal source, the passive feeding elements 920 and 940 are not connected to any signal source. FIG. 9B illustrates the result of adding the passive feeding elements to the antenna element 900 in terms of port isolation and return loss for each of the ports. The dual polarized passive feed embodiments allow for very good port isolation and low cross polarization.

FIG. 10 illustrates an exemplary dual polarized antenna element with an improved port isolation and cross polarization orthogonality according to another embodiment. The field symmetry and axial ratio of the radiated waves is improved by adding differentially fed feeding elements (1020 and 1040) at the opposite ends of the radiating slots from the corresponding feeding elements (1010 and 1030). The additional feeding elements 1020 and 1040 are differentially fed by using splitter structures (1012 and 1013) connecting the feeding elements 1010 and 1030 to their respective opposing feeding elements 1020 and 1040. The feeding structures are fed through the input ports 1014 (Input port 1) and 1015 (Input port 2). The dual polarized differential feed embodiments allow for very good port isolation and low cross polarization.

In the embodiments described herein the feeding element of each antenna element is located inside the cavity with no dielectric material added on top of the radiating slot. Thus, as opposed to existing slot antennas with a feeding element on top of the radiating slot, the present embodiments do not face the issue of surface and reflected waves. Further, the bandwidth of each antenna element is increased by impedance matching at two resonant frequencies. The dual frequency impedance matching is achieved by the feeding element located inside the cavity, which includes the feeding line extending across the radiating slot as well as a stub. An extension of the feeding line past the radiating slot acts as a tuning stub and excites the slot at a first resonant frequency. Further, and in contrast with known prior art slot antenna designs, the stub that is part of the feeding element allows for impedance matching at a second resonant frequency. In addition, the stub is located inside the cavity thereby minimizing, the associated element size and loss as well as maximizing the impedance matching bandwidth.

As shown herein, the embodiments of antenna elements present several advantages when compared to existing slot antennas. For example, as a result of the omission of dielectric material on top of the slot radiator (which ensures that no surface and reflected waves are present) scan blindness is avoided. The antenna elements of the various embodiments achieve a large impedance matching bandwidth (e.g., 11% at 10 dB return loss), with well-behaved radiation patterns that have similar beam widths in the E-plane and in the H-plane over this bandwidth.

While embodiments of the invention have been described in relation to a transmitting antenna element, other embodiments can include a receiving antenna element, in which the feeding element is coupled to a receiver for receiving radio waves. Therefore, embodiments of the invention are not limited to transmitting antenna elements.

While the invention has been described in terms of several embodiments, those skilled in the art will recognize that the invention is not limited to the embodiments described, can be practiced with modification and alteration within the spirit and scope of the appended claims. The description is thus to be regarded as illustrative instead of limiting.

What is claimed is:

1. An antenna element comprising:

a housing having a base and a conducting plate, the housing having a cavity formed between the base and the conducting plate, the cavity being coupled to the conducting plate at an upper edge of the housing, the conducting plate having a radiating slot with a length and a width that extends longitudinally along a first axis and a second axis, respectively, the radiating slot having a first and a second edge along the first axis; and a feeding element having a feeding point, a feeding line and a stub, wherein the feeding element is a stripline located in a layer between the conducting plate and a ground plane at the base and located in the cavity at a first predetermined distance between the base and the conducting plate for enabling dual resonant frequency impedance matching, the feeding line extending along the second axis of the conducting plate across the width of the radiating slot such that a first end of the feeding line is coupled with the feeding point on one side of the radiating slot, adjacent the first edge of the radiating slot and a second end of the feeding line extends past the second edge of the radiating slot, and the stub extending laterally of the feeding line.

2. The antenna element of claim 1, wherein the antenna element further comprises two or more stubs, each one of the two or more stubs is coupled to the feeding line at a respective distance and is located between the first end of the feeding line and the first edge of the radiating slot.

3. The antenna element of claim 1, wherein walls of the housing are formed using vias connecting the conducting plate with a ground plane forming the base of the housing.

4. The antenna element of claim 1, wherein the first predetermined distance is mid-way between the base and the conducting plate.

5. The antenna element of claim 1, wherein the feeding element is an active feeding element and the feeding line is an active feeding line and is to be coupled with a signal source through the feeding point, and wherein the antenna element further comprises:

a passive feeding element, un-coupled from a signal source, including a passive feeding line located at an opposite end of the radiating slot away from the active feeding element, the passive feeding line extending across the radiating slot such that a first end of the passive feeding line extends past the second edge of the radiating slot and a second end of the passive feeding line extends past the first edge of the radiating slot.

6. The antenna element of claim 5, wherein the passive feeding element further includes a passive stub extending laterally of the passive feeding line.

7. The antenna element of claim 1, wherein the radiating slot is a first radiating slot and the conducting plate defines a second radiating slot at right angle to the first radiating slot for enabling a dual polarized cavity backed slot antenna element, the second radiating slot having a first edge and second edge along the second axis, the antenna element further comprises:

a second feeding element having a second feeding point, a second feeding line and a second stub, the second feeding element of the second radiating slot is located in the cavity at a first predetermined distance between the base and the conducting plate, the second feeding line of the second radiating slot extending along the first axis of the conducting plate across the width of the second radiating slot such that a first end of the second feeding line of the second radiating slot is coupled with the second feeding point of the second radiating slot on one side thereof, adjacent one edge of the second radiating slot and a second end of the second feeding line extends past another edge of the second radiating slot, and the second stub of the second feeding line extending laterally of the second feeding line.

8. The antenna element of claim 1, wherein the stub extends laterally of the feeding line, perpendicular thereof for a first portion of the stub and parallel to the feeding line for a second portion of the stub.

9. The antenna element of claim 1, wherein the cavity in said housing is formed between the base, the conducting plate and a plurality of spaced apart vias extending between the base and the conducting plate to form cavity walls.

10. The antenna element of claim 9, wherein the vias are spaced apart at a distance of less than or equal to 0.1 wavelength of an operating frequency of the antenna element.

11. The antenna element of claim 1, wherein the cavity has at least one of an octagonal, circular and rectangular shape.

12. The antenna element of claim 1, wherein the antenna element is realized as a multilayer printed circuit board (PCB) structure.

13. The antenna element of claim 1, wherein the cavity is formed of a dielectric material.

14. The antenna element of claim 1, wherein a shape of the radiating slot is at least one of a concave bisymmetric hexagon, a trapezoid, a rectangle, a convex polygon.

15. An antenna element comprising:

a housing having a base and a conducting plate, the housing having a cavity formed between the base and the conducting plate, the cavity being coupled to the conducting plate at an upper edge of the housing, the conducting plate having a first radiating slot with a length and a width that extends longitudinally along a first axis and a second axis, respectively, the first radiating slot having a first and a second edge along the first axis, and the conducting plate defines a second radiating slot at right angle to the first radiating slot for enabling a dual polarized cavity backed slot antenna element, the second radiating slot having a first edge and second edge along the second axis;

a first feeding element having a first feeding point, a first feeding line and a first stub, the first feeding element is located in the cavity at a first predetermined distance between the base and the conducting plate for enabling dual resonant frequency impedance matching, the first feeding line extending along the second axis of the conducting plate across the width of the first radiating slot such that a first end of the feeding line is coupled with the feeding point on one side of the radiating slot, adjacent the first edge of the radiating slot and a second end of the feeding line extends past the second edge of the radiating slot, and the stub extending laterally of the feeding line; and a second feeding element having a second feeding point, a second feeding line and a second stub, the second feeding element of the second radiating slot is located in the cavity at a first predetermined distance between the base and the conducting plate, the second feeding line of the second radiating slot extending along the first axis of the conducting plate across the width of the second radiating slot such that a first end of the second feeding line of the second radiating slot is coupled with the second feeding point of the second radiating slot on one side thereof, adjacent one edge of the second radiating slot and a second end of the second feeding line extends past another edge of the second radiating slot, and the second stub of the second feeding line extending laterally of the second feeding line.

16. The antenna element of claim 15, wherein the first stub extends laterally of the first feeding line, perpendicular thereof for a first portion of the first stub and parallel to the first feeding line for a second portion of the first stub; and wherein the second stub extends laterally of the second feeding line, perpendicular thereof for a first portion of the second stub and parallel to the second feeding line for a second portion of the second stub.

17. The antenna element of claim 15, wherein the first feeding element is a first active feeding element and the first feeding line is a first active feeding line and is to be coupled with a signal source through the first feeding point, and the second feeding element is a second active feeding element and the second feeding line is a second active feeding line and is to be coupled with a signal source through the second feeding point, and wherein the antenna element further comprises:

a first passive feeding element, un-coupled from a signal source, including a first passive feeding line located at an opposite end of the first radiating slot away from the first active feeding element, the first passive feeding line extending across the first radiating slot such that a first end of the first passive feeding line extends past the second edge of the first radiating slot and a second end of the first passive feeding line extends past the first edge of the first radiating slot; and a second passive feeding element, un-coupled from a signal source, including a second passive feeding line located at an opposite end of the second radiating slot away from the second active feeding element, the second passive feeding line extending across the second radiating slot such that a first end of the second passive feeding line extends past the second edge of the radiating slot and a second end of the passive feeding line extends past the first edge of the second radiating slot.

18. The antenna element of claim 17, wherein the first passive feeding element further includes a first passive stub extending laterally of the first passive feeding line; and wherein the second passive feeding element further includes a second passive stub extending laterally of the second passive feeding line.

19. The antenna element of claim 15, wherein the first predetermined distance is mid-way between the base and the conducting plate.

* * * * *